US009567739B2

(12) United States Patent
Nyce

(10) Patent No.: US 9,567,739 B2
(45) Date of Patent: Feb. 14, 2017

(54) FLOOR DRAIN ASSEMBLY SYSTEM AND METHOD OF FORMING THE SAME

(71) Applicant: Oldcastle Precast, Inc., Auburn, WA (US)

(72) Inventor: Daniel Nyce, Perkasie, PA (US)

(73) Assignee: Oldcastle Precast, Inc., Auburn, WA (US)

( * ) Notice: Subject to any disclaimer, the term of this patent is extended or adjusted under 35 U.S.C. 154(b) by 0 days.

(21) Appl. No.: 14/674,376

(22) Filed: Mar. 31, 2015

(65) Prior Publication Data

US 2015/0275497 A1 Oct. 1, 2015

Related U.S. Application Data

(60) Provisional application No. 61/973,377, filed on Apr. 1, 2014.

(51) Int. Cl.
*E03F 5/04* (2006.01)

(52) U.S. Cl.
CPC ..... *E03F 5/0407* (2013.01); *E03F 5/0409* (2013.01)

(58) Field of Classification Search
CPC ..... E03F 5/0407; E03F 5/0408; E03F 5/0409; E03C 1/122
USPC ..... 52/302.1, 302.7
See application file for complete search history.

(56) References Cited

U.S. PATENT DOCUMENTS 2,672,205 A * 3/1954 McDonald ..... E03C 1/22 210/163
4,146,939 A * 4/1979 Izzi ..... E03F 5/0409 4/286
4,198,715 A * 4/1980 Daniels ..... A47K 3/284 4/612
4,594,740 A * 6/1986 Tseronakis ..... E03C 1/29 137/247.35
5,022,430 A * 6/1991 Degooyer ..... E03F 5/0407 137/362
5,408,706 A * 4/1995 Barnes ..... E03F 5/0407 210/163
5,724,777 A * 3/1998 Hubbard ..... E04D 13/0409 210/163
5,742,956 A 4/1998 Tarver
6,269,495 B1 * 8/2001 Sondrup ..... E03C 1/22 210/163
7,624,759 B1 * 12/2009 Ismert ..... E03C 1/22 138/89
7,946,087 B1 * 5/2011 Seitzinger ..... E04D 13/0409 52/196
7,958,686 B1 * 6/2011 Majocka ..... E03F 5/0407 52/302.1
8,596,021 B2 12/2013 Van Ravenhorst
8,661,574 B2 * 3/2014 Larsson ..... E03F 5/0407 4/287
8,918,926 B1 * 12/2014 Herring ..... E03F 5/0408 4/613
2007/0017578 A1 * 1/2007 Dallmer ..... E03F 5/0408 137/362

(Continued)

FOREIGN PATENT DOCUMENTS

JP 2004340887 * 12/2004 ..... G21C 19/06

*Primary Examiner* — Joshua J Michener
*Assistant Examiner* — Alp Akbasli
(74) *Attorney, Agent, or Firm* — Sheridan Ross P.C.

(57) ABSTRACT

Flooring and drain assemblies are provided. The assemblies provide a plurality of panels or flooring members for surrounding and directing fluid toward a drain body. Assemblies include a drain body may be secured to or in fluid communication with additional plumbing features, and layers or features for connecting the assembly. The drain body is connected to at least one the flooring members in various ways to promote proper floor drainage.

16 Claims, 7 Drawing Sheets

(56) References Cited

U.S. PATENT DOCUMENTS

| | | | | |
|---|---|---|---|---|
| 2007/0056088 | A1* | 3/2007 | DeGooyer | E03C 1/20 4/613 |
| 2008/0106094 | A1* | 5/2008 | Edelmayer | E03F 5/0409 285/42 |
| 2008/0290012 | A1* | 11/2008 | Shih | E03F 5/0407 210/163 |
| 2008/0308476 | A1* | 12/2008 | Silverstein | E03F 5/0407 210/163 |
| 2010/0043136 | A1* | 2/2010 | Michael | A47K 3/40 4/613 |
| 2010/0176041 | A1* | 7/2010 | Schlueter | E03F 5/0407 210/163 |
| 2012/0036697 | A1* | 2/2012 | Cook | E03F 5/0407 29/428 |
| 2013/0000035 | A1* | 1/2013 | Wedi | E03F 5/0407 4/681 |
| 2013/0174921 | A1* | 7/2013 | Schluter | E03F 3/04 137/362 |
| 2013/0318705 | A1* | 12/2013 | Plank | E03F 5/0408 4/613 |
| 2014/0131996 | A1* | 5/2014 | Murphy | E03F 5/0409 285/136.1 |
| 2014/0157514 | A1* | 6/2014 | Cook | E03F 5/0408 4/679 |
| 2014/0230140 | A1* | 8/2014 | Davis, Jr. | A47K 3/40 4/613 |
| 2014/0352815 | A1* | 12/2014 | Brodey | E03F 5/0407 137/544 |

* cited by examiner

FLOOR DRAIN ASSEMBLY SYSTEM AND METHOD OF FORMING THE SAME

This U.S. Non-Provisional patent application claims the benefit of priority from U.S. Provisional Patent Application Ser. No. 61/973,377, filed Apr. 1, 2014, the entire disclosure of which is hereby incorporated by reference in its entirety.

FIELD

The present disclosure relates generally to the field of flooring. Specifically, various embodiments of the assemblies disclosed herein relate to a unique tapered floor and drain assembly.

BACKGROUND

Prior art modular building structures, specifically modular bathrooms such as that described in U.S. Pat. No. 8,596,021 to Van Ravenhorst, which is hereby incorporated by reference in its entirety, provide a flooring system referred to as the "Unifloor" system, and which is described as a composite construction (laminated fiberglass reinforced plastic) floor which can embody a simulated tile pattern, serves as the finished floor of the bathroom. In upscale environments such as high end commercial buildings and hotels, simulated finishes are not desirable.

U.S. Pat. No. 5,742,956 Tarver, which is hereby incorporated by reference in its entirety, teaches a modular bathroom unit floor fabricated of, for example, foam core material such as plywood sides having polystyrene foam or the like juxtaposed there between. Besides the well-known limitations of plywood as a moisture barrier, the moisture retention properties of plywood and resulting mold or mildew issues that can occur make plywood a less than desirable choice for flooring solutions in an environment that may be exposed to water. The use of plywood also results in increased weight to the bathroom module unit which increases shipping cost of the units.

SUMMARY

In view of the limitations now present in the prior art systems for flooring and drain system, embodiments described herein provide a novel tapered floor and drain assembly which is more efficient to manufacture, more systematic and organized for installation and more versatile in application and operation than known prior art systems. In certain embodiments, a modular system is provided wherein a drain assembly comprises multiple components and/or flooring members.

An object of certain embodiments of the disclosed system is to provide a new tapered floor and drain assembly for use within a modular building structure that will increase efficiency during the manufacturing, assembly, and installation processes. It is also a purpose of the disclosure to provide a new tapered floor and drain assembly that has many novel features not offered by the prior art, such as lightweight honeycomb flooring lower sub-panels and bisected honeycomb upper subpanels that allow for precision tapering of the floor towards the drain component as well superior structural support while reducing the overall weight of the floor. These are a few of the novel features that result in a new and unique tapered floor and drain assembly which is not apparent, obvious, or suggested, either directly or indirectly by any of the prior art device apparatus, or methods.

In various embodiments, subfloor panel members are provided that may be selectively customized. For example, in certain embodiments, at least one of an upper subfloor panel and a lower subfloor panel as shown and described herein comprises a honeycomb panel wherein the panel may be shaved, cut, molded, shaped, and/or compressed to provided a desired slope to the panel. For example, a honeycomb panel may extend substantially horizontally as a flat flooring surface along a portion of its area, while being shaped, angled, or tapered toward a drain feature surrounded by the panel(s).

There is a need for a bathroom unit flooring solution that is not only lightweight and structurally durable, and further allows for authentic finishes such as marble, granite, tile, stone, epoxy, composite or vinyl to be installed over the subfloor. Embodiments of the disclosure provide such a solution. The properties of the honeycomb material provide superb strength and structural support in the sub floor materials. The honeycomb material also allows the bisected honeycomb upper subfloor to be easily fabricated with a controlled, designed, tapered slope towards the drain unit to ensure that liquids will be gravity fed to the drain unit.

In various embodiments, lower and upper subfloor panels can be machine fabricated to provide increased accuracy and precision of fit as well as efficient modular production. The adhesives used are intended to be industry accepted materials for adhering and securing the component materials in position. The use of a water proof membrane in certain embodiments ensures that any water introduced into the environment will be collected and guided to the drain unit without causing damage to the main floor system components.

In one embodiment, a drain assembly is provided for a gravity fed floor drain, the assembly comprising a subfloor panel, a drain member comprising a drain outlet extending downwardly into the subfloor panel, and a flange extending laterally away from the drain outlet over at least a portion of the subfloor panel. An adhesive layer is provided to secure an underside of the flange to the subfloor panel. A flooring surface is provided, the flooring surface comprising a material that is substantially non-permeable to liquids, the flooring surface extending outwardly away from the drain member, and wherein the flooring surface comprises a first slope and a second slope. The first slope is provided at a location distal to the drain member, and the second slope is provided at a location vertically above and/or within an area defined by the flange, and the second slope is greater than the first slope to promote drainage into the drain member.

It is anticipated that the honeycomb subfloor panels can be fabricated as a single piece floor unit or as an assemblage of smaller section that when combined create a complete floor unit.

In certain embodiments, drain bodies of the present disclosure comprises circular drain members. Such circular drain members may be rotated even when in provided in a recess or cutout of the subfloor panel or other flooring components, thereby facilitating insertion and/or threading of a drain body with additional plumbing fixtures or features.

In certain embodiments, the present disclosure provides for methods for constructing a floor drain assembly. In one embodiment, a method for constructing a floor drain assembly is provided, the method comprising the steps of providing a first subfloor panel to a slab or foundation, the foundation comprising a void or aperture for plumbing. A second subfloor panel is provided and adhered to the first subfloor panel. A drain module is provided, the drain module at least partially extending into the void or aperture of the foundation. A primary flooring layer is provided on top of the second subfloor panel, and wherein the primary flooring layer extends over at least a portion of the drain module. In certain embodiments, the primary flooring layer is compressed or secured between a portion of the drain module and a drain cover. The drain cover may be secured to the drain module by one or more fasteners. In certain embodiments, the first and/or second subfloor panel is tapered, shaped, contoured, and/or compressed such that a portion of the panel(s) located generally distal to the drain module comprises a flat portion and wherein a portion of the panel(s) located proximal the drain module comprises a slope or taper to facilitate drainage of liquid from the flooring member(s) to the drain module.

It is further contemplated that the entire completed floor assembly can be installed as a single flooring unit or the floor assembly can be installed one layer at a time to thereby create the completed floor while still performing the intended purpose and function of the disclosure.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosed embodiments.

It should be understood that the drawings are not necessarily to scale. In certain instances, details that are not necessary for an understanding of the disclosure or that render other details difficult to perceive may have been omitted. It should be understood, of course, that the disclosure is not limited to the particular embodiments illustrated herein.

Figure 1:
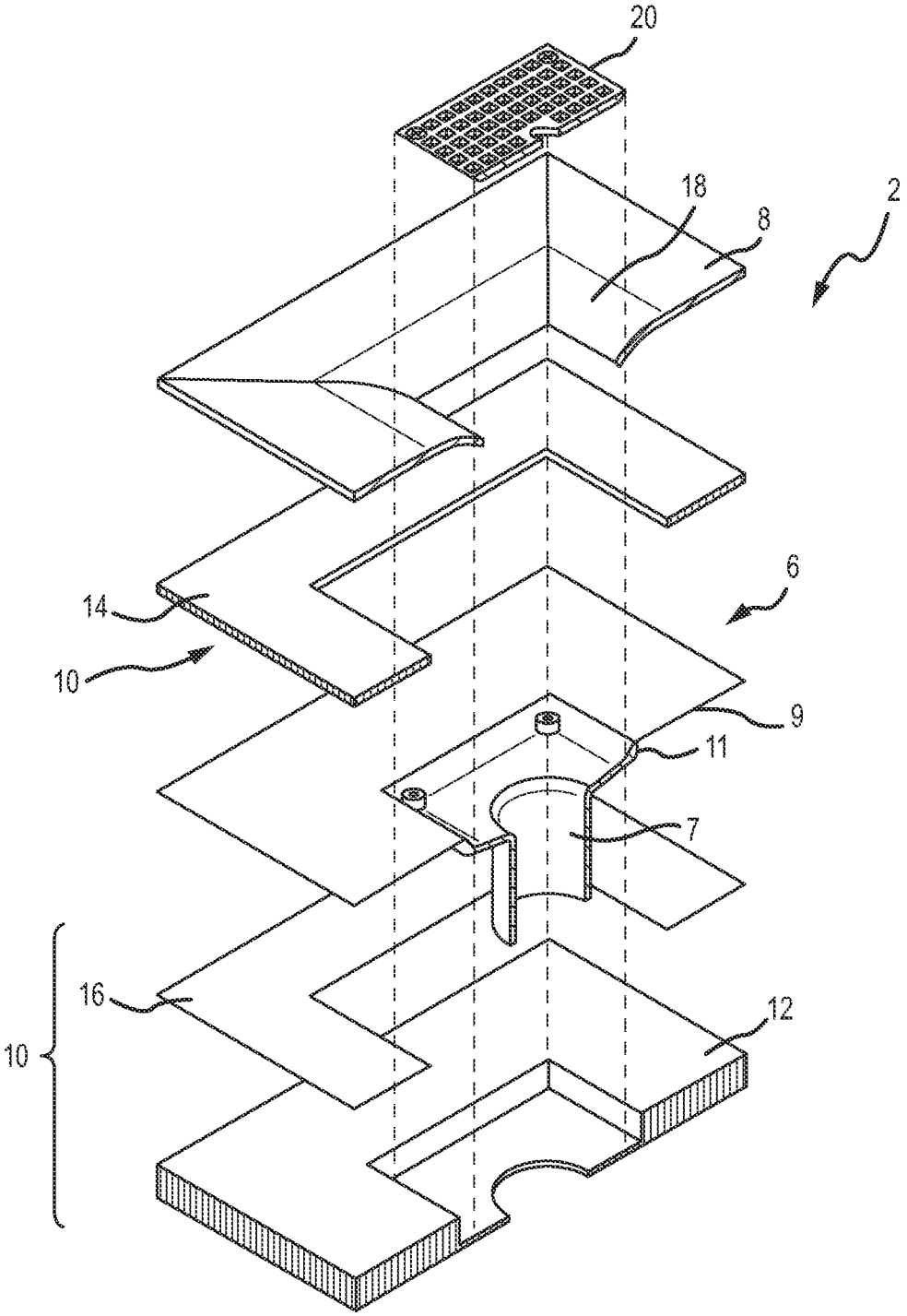

FIG. 1 is an exploded perspective view of components of a floor and drain assembly according to one embodiment of the disclosure.

Figure 2:
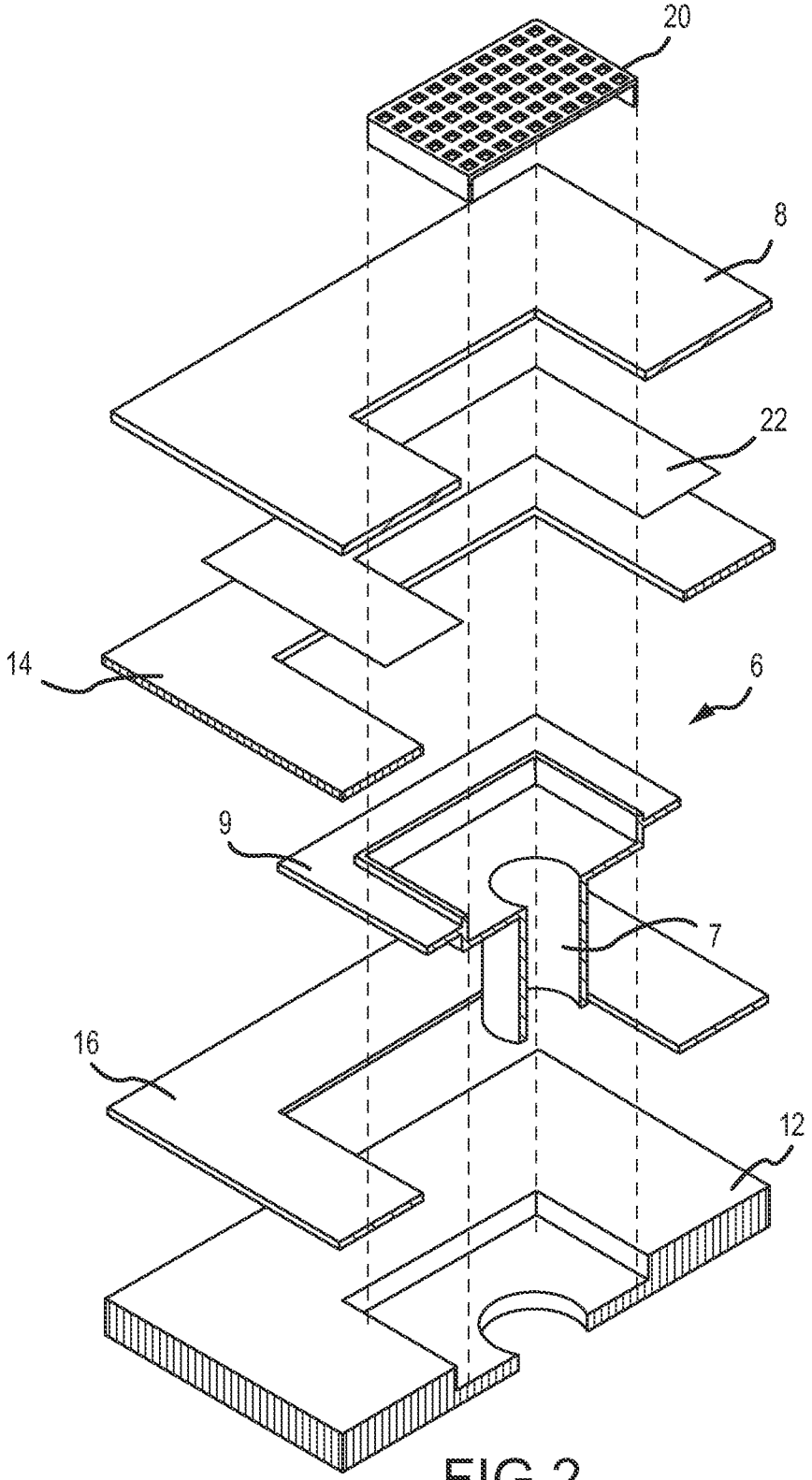

FIG. 2 is an exploded perspective view of components of a floor and drain assembly according to one embodiment of the disclosure.

Figure 3:
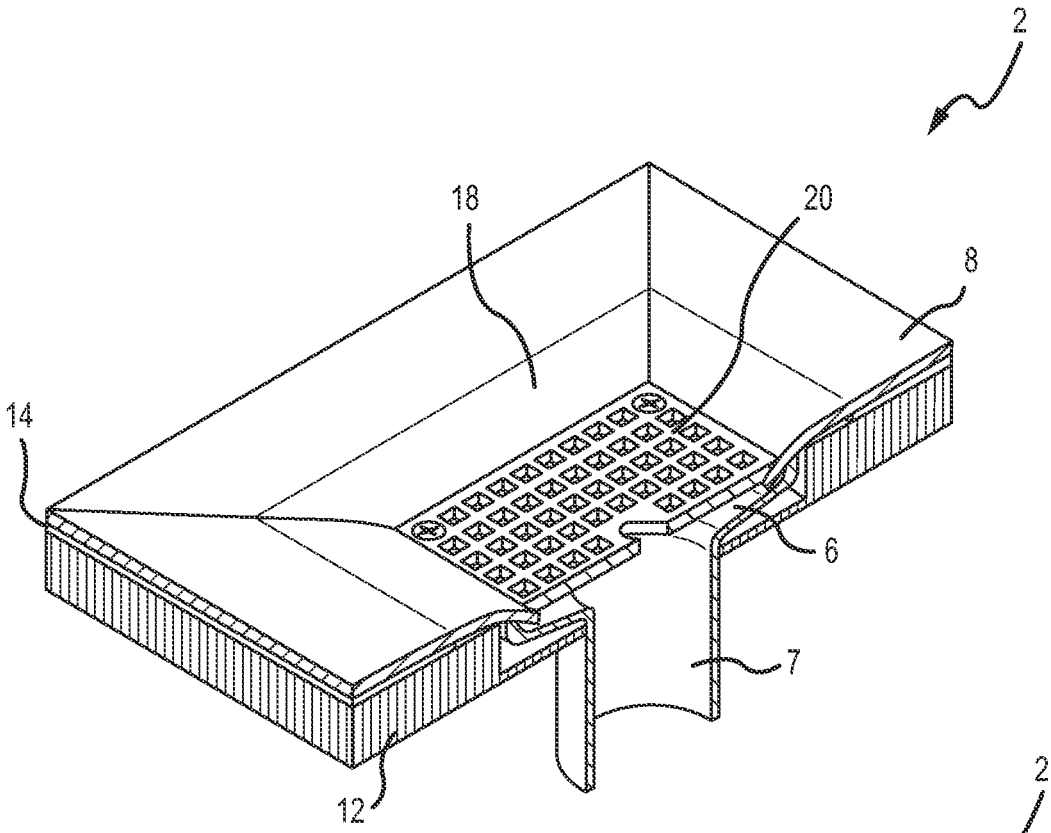

FIG. 3 is a perspective view of components of one embodiment of the disclosure in an assembled state.

Figure 4:
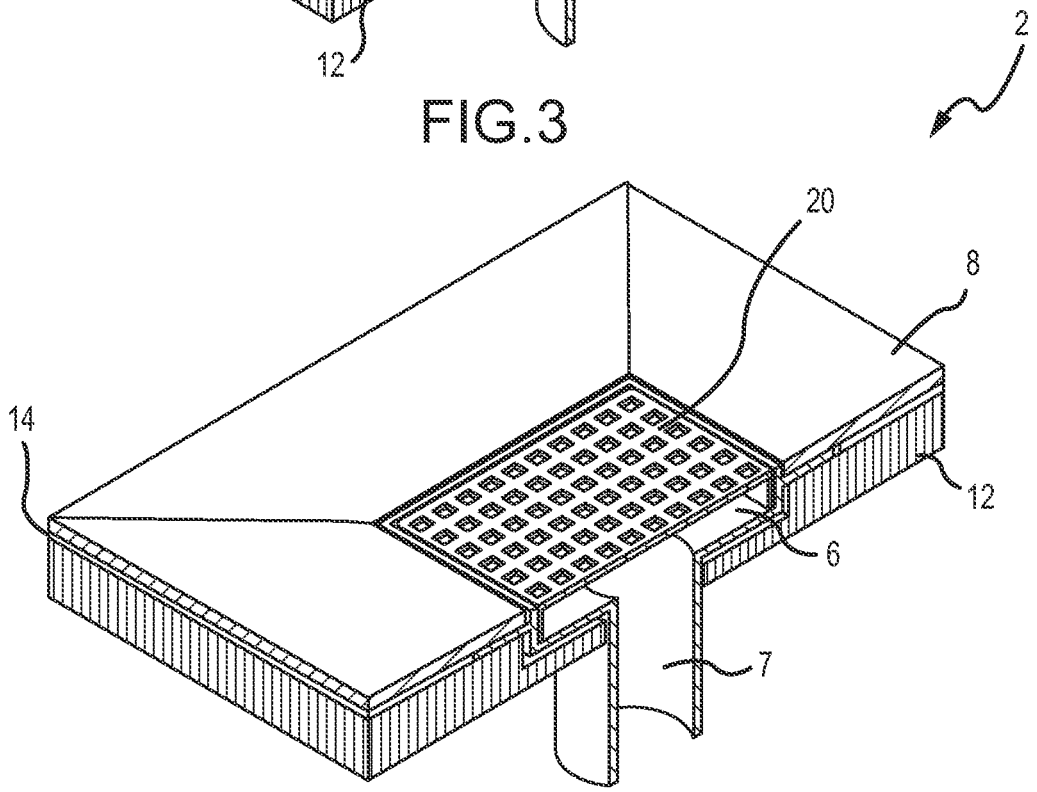

FIG. 4 is a perspective view of components of one embodiment of the disclosure in an assembled state.

Figure 5:
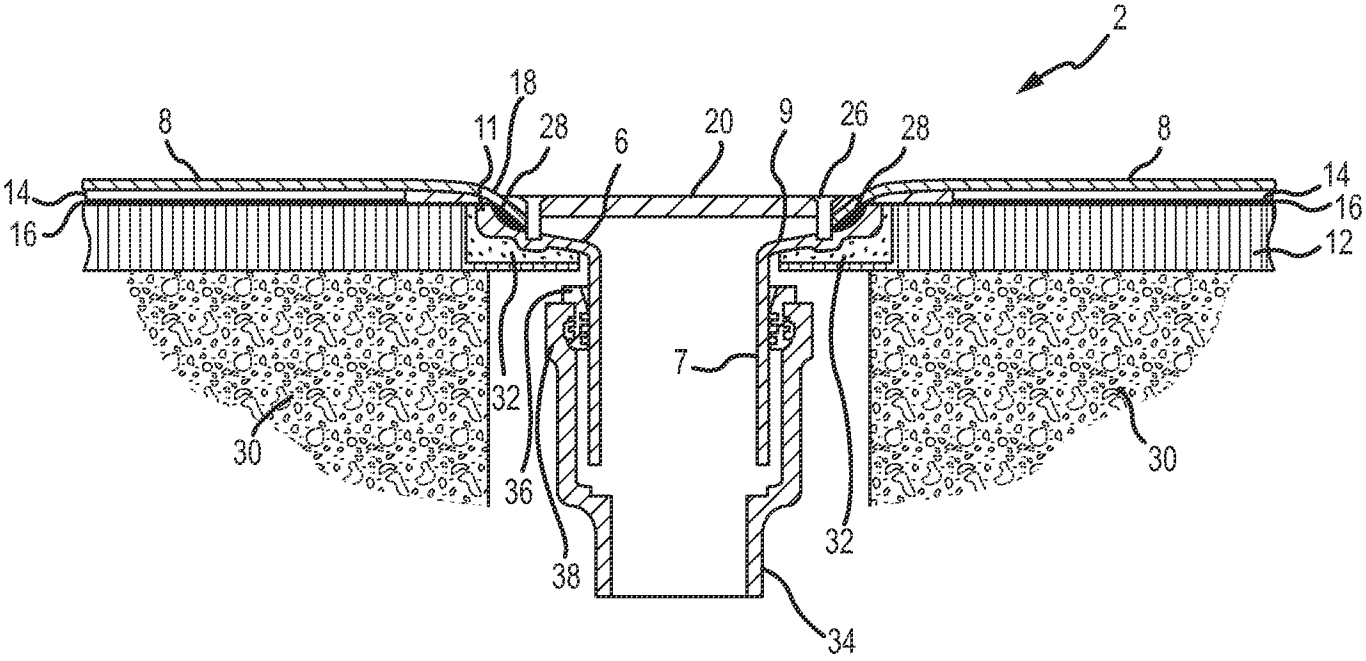

FIG. 5 is a cross-sectional elevation view of a floor and drain assembly according to one embodiment of the disclosure in an assembled state.

Figure 6:
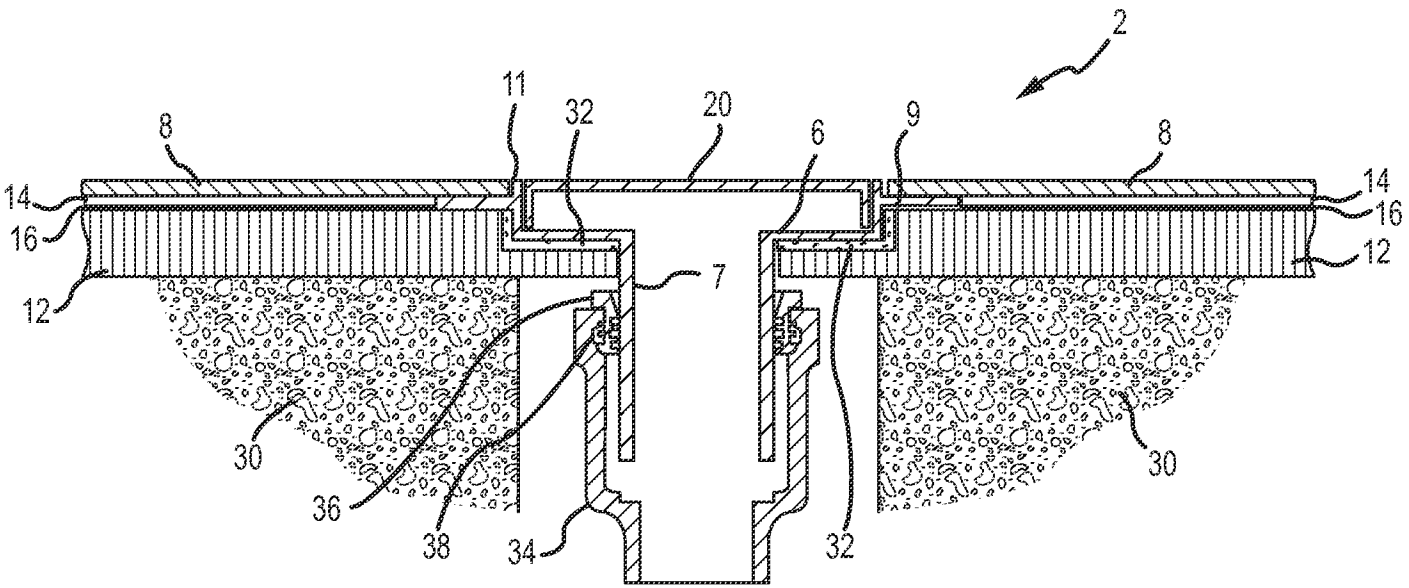

FIG. 6 is a cross-sectional elevation view of a floor and drain assembly according to one embodiment of the disclosure in an assembled state.

Figure 7:
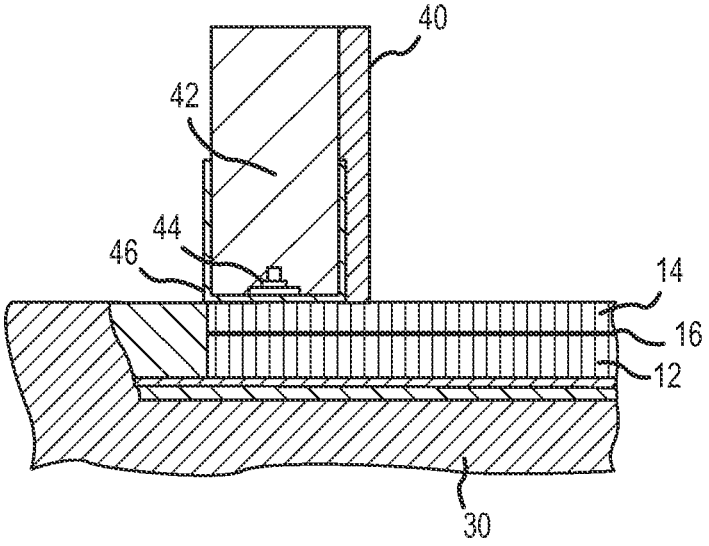

FIG. 7 is a cross-sectional elevation view of a floor and drain assembly according to one embodiment of the disclosure in an assembled state.

Figure 8:
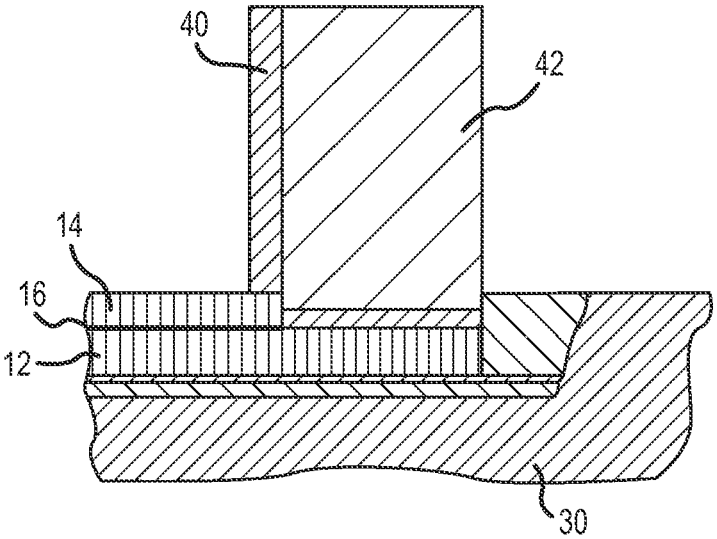

FIG. 8 is a cross-sectional elevation view of a floor and drain assembly according to one embodiment of the disclosure in an assembled state.

Figure 9:
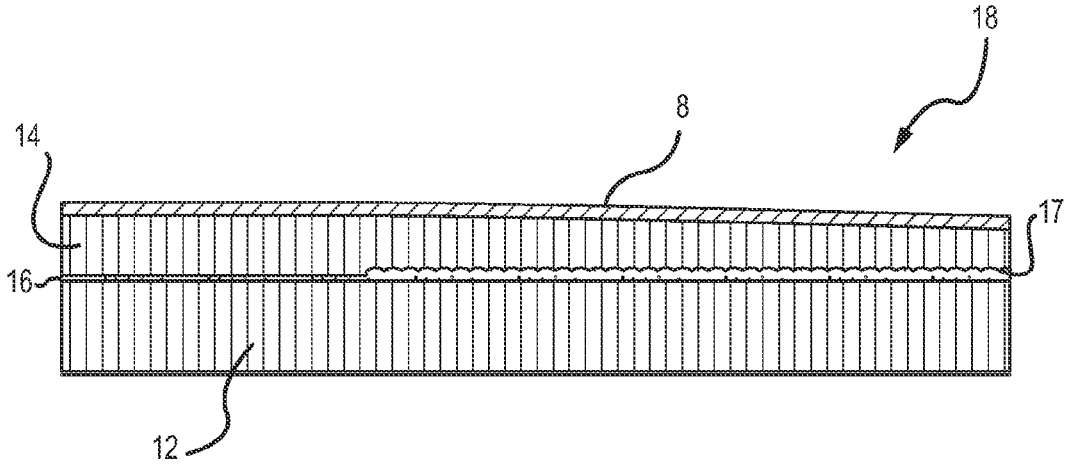

FIG. 9 is a cross-sectional elevation view of a floor and drain assembly according to one embodiment of the disclosure in an assembled state.

In order to assist with the understanding of the disclosure, the following is a listing of features provided in the drawings:

2 Drain Assembly
6 Drain Body
7 Downwardly Extending Channel
8 Primary Flooring Layer
9 Flange
10 Subflooring Assembly
11 Lip
12 Lower Subfloor Panel
14 Upper Subfloor Panel
16 Adhesive Layer
17 Adhesive
18 Tapered Region
20 Drain Cover
22 Waterproof Membrane
26 Fastener
28 Bonding Agent
30 Floor Slab
32 Bonding Agent
34 Pipe
36 Male Threaded Portion
38 Female Threaded Portion
40 Panel
42 Stud
44 Bolt
46 Track

DETAILED DESCRIPTION

In various embodiments, and referring now to FIGS. 1-9, the present disclosure provides a floor and drain assembly. In a preferred embodiment, a drain assembly 2 comprises a modular or multi-layer assembly including a drain body 6. The main floor assembly comprises a primary flooring layer 8, such as a vinyl flooring material, and a subflooring assembly 10. The subflooring assembly 10 preferably comprises a plurality of layers. In the depicted embodiment, the subflooring assembly 10 comprises at least one honeycomb lower subfloor panel 12, at least one bisected honeycomb upper subfloor panel 14, and a layer of epoxy adhesive 16 between the at least one honeycomb lower subfloor panel 12 and the at least one bisected honeycomb upper subfloor panel 14. In a preferred embodiment of the disclosure, a primary flooring layer 8 comprises a vinyl or tile flooring surface on top of a subfloor assembly with a drain body 6 surrounded by the flooring members. The drain body 6 may be secured to and/or within the layers of the assembly in various ways and as shown and described herein. The drain body 6 is provided at least partially within a cutout or recess provided in the lower subfloor panel 12 as shown in FIG. 1, for example.

FIG. 1 provides an exploded cross-sectional view of a modular drain assembly 2 according to one embodiment. As shown, the system comprises a subfloor panel 12, an adhesive layer 16, a drain body 6, an upper subfloor panel 14, a flooring member 8 with a tapered surface or region 18, and a drain cover 20. Although FIG. 1 depicts a preferred embodiment wherein certain features are contemplated as being stacked in a generally concentric manner around a drain, the present disclosure is not so limited. Indeed, the addition and/or exclusion of various features shown in FIG. 1 is contemplated. FIG. 1 depicts an embodiment wherein a drain body 6 is provided in combination with and provided between a subfloor panel 12 and a flooring member 8. In various embodiments, a drain body 6 comprises a downwardly extending channel 7. Fluid collected or received by a remainder of the drain body 6 is directed toward the downwardly extending channel 7 where fluid is directed substantially vertically downward toward other components or features such as piping or storage features.

As shown in FIG. 2, an embodiment of the disclosure is provided wherein a floor tile or tiling is provided as the primary flooring layer 8. Additionally, the embodiment of FIG. 2 further comprises a waterproof membrane 22 between a top surface of a bisected honeycomb upper subfloor panel 14 and the underside of the primary flooring layer 8. An adhesive material or layer 16 may also be inserted between the at least one bisected honeycomb upper subfloor panel 22 and the subfloor panel 12.

FIG. 3 is a cross-sectional perspective view of a drain assembly 2 according to one embodiment of the disclosure. As shown, the drain assembly comprises a drain cover 20, a primary flooring layer 8 with a tapered region 18 extending at least partially beneath the drain cover 20, a drain body 6, and a lower subfloor panel 12 with an upper subfloor panel 14 preferably adhered thereto. As shown, the primary flooring layer 8 extends into an outer perimeter of the drain body 6 such that fluids provided to an upper surface of the primary flooring member 8 will drain through the drain cover 20 and be funneled or directed into the drain body 6 and through the downwardly extending channel 7. In the embodiment shown in FIG. 3, the primary flooring member 8 comprises a tapered and/or flexible flooring material, such as linoleum or similar material(s) that may be bent or warped to a preferred orientation and provide a desired slope as shown in FIG. 3.

FIG. 4 is a cross-sectional perspective view of another embodiment of the present disclosure comprising a drain assembly 2. As shown in FIG. 4, the drain assembly 2 comprises a primary flooring layer 8, a drain cover 20, a drain body 6 with a downwardly extending channel 7, a lower subfloor panel 12 and an upper subfloor panel 14. In the embodiment of FIG. 4, the primary flooring member 8 terminates adjacent to an outer edge of the drain body 6, and does not extend over the drain body 6 or under the drain cover 20 as in alternative embodiments. Embodiments as shown in FIG. 4 may comprise a sealant, caulk, or adhesive layer provided at a union of the drain body 6 and the primary flooring layer 8 to prevent leaking of fluids between these two components.

FIG. 5 is a cross-sectional elevation view of the embodiment of FIG. 3. As shown, a drain body 6 is provided within a foundation or floor 30 for draining fluid from an upper surface thereof. The drain body 6 comprises a downwardly extending channel 7 that extends into a depth of the floor 30. The floor 30 is provided with a lower subfloor panel 12 and an upper subfloor panel 14, the upper subfloor panel 14 being preferably adhered to the lower subfloor panel 12 by an adhesive layer 16. A primary flooring member 8 is provided as an upper surface and slopes downwardly to the drain body 6. The primary flooring member 8 preferably comprises a vinyl or similar material and extends over a perimeter of the drain body 6, and is secured to the drain body with an adhesive, silicone, or similar bonding agent 28. A drain cover 20 is provided and is preferably secured to the drain body 6 by at least one fastener 26. The fastener 26 and drain body also provide a clamping or securing force to secure a portion of the primary flooring member 8 between the drain body 6 and the drain cover 20. A flanged portion 9 of the drain body 6 extends outwardly away from the downwardly extending channel 7, and in the embodiment of FIG. 5 is secured to the lower subfloor panel 12 by an epoxy 32 or similar bonding agent. Flanged portions 9 of the drain body 6 may comprise various different shapes and structures. In the embodiment depicted in FIG. 5, for example, the flange 9 extends outwardly away from the downwardly extending channel 7 and comprises a slight angle to promote drainage (i.e. the flange 9 is not perpendicular to the channel 7). The flange 9 as shown in FIG. 5 further comprises a lip 11 to further promote drainage. In certain embodiments, the lip 11 extends substantially vertically to create a bowl-shaped feature. The flooring member 8 extends over the lip 11. In FIG. 5, the downwardly extending channel 7 of the drain body 6 mates with additional plumbing, shown as pipe 34. In certain embodiments, the drain body 6 comprises a male threaded portion 36 for securing to a female threaded portion 38 of the pipe 34. In alternative embodiments, it is contemplated that the downwardly extending channel 7 is connected to the pipe 34 by adhesive, lock rings, collars, clamps, etc., or simply extends downwardly into the pipe 34 without securing means provided therebetween.

FIG. 6 is a cross-sectional elevation view of the embodiment of FIG. 4. As shown, a drain body 6 is provided within a foundation or floor 30 for draining fluid from an upper surface thereof. The drain body 6 comprises a downwardly extending channel 7 that extends into a depth of the floor 30. The floor 30 is provided with a lower subfloor panel 12 and an upper subfloor panel 14, the upper subfloor panel 14 being preferably adhered to the lower subfloor panel 12 by an adhesive layer 16. A primary flooring member 8 is provided as an upper surface and slopes downwardly to the drain body 6. The primary flooring member 8 preferably comprises a vinyl or similar material and extends over a portion of the drain body 6, and is secured to the drain body with an adhesive, silicone, or similar bonding agent. A drain cover 20 is provided and may be secured to the drain body 6 by at least one fastener, or simply allowed to rest on the drain member 6. A flanged portion 9 of the drain body 6 extends outwardly away from the downwardly extending channel 7, and in the embodiment of FIG. 6 is secured to the lower subfloor panel 12 by an epoxy or similar bonding agent. Flanged portions 9 of the drain body 6 may comprise various different shapes and structures. In the embodiment depicted in FIG. 6, for example, the flange 9 extends outwardly away from the downwardly extending channel 7 and comprises a substantially horizontal extension wherein at least a portion of the flange 9 is substantially perpendicular to the channel 7. The flange 9 as shown in FIG. 6 further comprises a lip 11 to further promote drainage. In certain embodiments, the lip 11 extends substantially vertically to create a bowl or cup shaped feature. The flooring member 8 of FIG. 6 extends to the lip 11. In FIG. 6, the downwardly extending channel 7 of the drain body 6 mates with additional plumbing, shown as pipe 34. In certain embodiments, the drain body 6 comprises a male threaded portion 36 for securing to a female threaded portion 38 of the pipe 34. In alternative embodiments, it is contemplated that the downwardly extending channel 7 is connected to the pipe 34 by adhesive, lock rings, collars, clamps, etc., or simply extends downwardly into the pipe 34 without securing means provided therebetween.

FIG. 7 is a cross-sectional elevation view of certain features of a floor assembly suitable for use with drain assemblies as shown and described herein. As shown in FIG. 7, a floor slab 30 or foundation is provided with a lower subfloor panel 12 upon which an upper subfloor panel 14 is secured by at least one adhesive layer 16. A track 46 is provided on an upper surface of the upper subfloor panel 14, the track 46 provided to receive and support a wall panel or member, such as a light gauge metal stud 42 and associated panel 40. The panel 40 as shown in FIG. 7 may comprise a FIBEROCK® panel, a sheet rock panel, drywall, or any suitable or desired panel for providing a wall panel. A fastener, such as bolt 44, is provided to secure the track 46 to the flooring assembly. The bolt 44 may extend to any desired depth including, but not limited to, into the floor slab 30. The bolt 44 preferably extends through at least one of the upper 14 and lower 12 subfloor panels to provide appropriate structural integrity to a wall panel.

FIG. 8 is a cross-sectional side elevation view of a floor assembly according to another embodiment. As shown in FIG. 8, a floor assembly is provided comprising a lower subfloor panel 12 and an upper subfloor panel 14, and wherein a track 46 is secured to the lower subfloor panel 12 such that the track 46 and associated wall support or stud 42 are recessed with respect to the flooring assembly. As shown in FIG. 8, a panel 40 is provided on an upper surface of the upper subfloor panel 14.

FIG. 9 is a cross-sectional side view of a floor assembly according to one embodiment of the disclosure. As shown, a lower subfloor panel 12 is provided, and an upper subfloor panel 14 is provided on the lower panel 12. As shown in FIG. 9, the lower 12 and upper 14 subfloor panels are secured together by at least one of an adhesive layer 16 and an adhesive 17 such as epoxy, silicone, etc. A primary flooring layer 8 is provided as an upper surface of the assembly. The assembly comprises a tapered region 18 wherein a slope of the at least the upper surface of the flooring assembly is not parallel to a foundation slab 30 or lower subfloor panel 12. The tapered region 18 comprises a slope to allow fluids to be gravity fed toward a desired location, such as a location wherein a drain assembly as shown and described herein is provided. The slope of the tapered region 18 may be provided by altering the upper subfloor panel 14, such as by removing or shaping certain portions of the upper subfloor panel 14 to have a desired slope. Alternatively, the flooring assembly may be compressed at or proximal to a drain feature, such as by providing a drain cover 20 and fasteners 26 to compress a flooring area proximal to a drain and promote drainage of fluid into the drain.

The foregoing has outlined, in general, the intended use and function as well as the physical aspects of the disclosure and is to serve as an aid to better understanding the assemblies disclosed herein. In reference to such, there is to be a clear understanding that the present disclosure is not limited to the method or detail of construction, fabrication, material, or application of use described and illustrated herein. Any other variation of fabrication, use, or application should be considered apparent as an alternative embodiment of the disclosure.

What is claimed is:

1. A drain assembly for a gravity fed floor drain, the assembly comprising:

a lower subfloor panel and an upper subfloor panel, the lower subfloor panel and the upper subfloor panel secured together by an adhesive layer provided therebetween;

a drain member comprising a drain outlet extending downwardly into the upper subfloor panel and the lower subfloor panel, and a flange extending laterally away from the drain outlet over at least a portion of the lower subfloor panel;

a drain cover operable to be selectively secured to at least one of the drain member and the flooring surface;

a flooring surface comprising a material that is substantially non-permeable to liquids, the flooring surface surrounding and extending outwardly away from the drain member, and wherein the flooring surface comprises a first slope and a second slope;

wherein the upper subfloor panel comprises a bisected honeycomb panel member provided between the flooring surface and the lower subfloor panel, the bisected honeycomb panel member operable to provide a tapered slope to the flooring surface in an assembled state;

wherein at least a portion of the flooring surface extends over at east a portion of the flange of the drain member, and wherein at least a portion of the flooring surface is compressed beneath the drain cover and secured to the flange by an adhesive; and the first slope provided at a location distal to the drain member, and the second slope provided at a location proximal to the drain member.

2. The drain assembly of claim 1, wherein the first slope comprises a substantially horizontal floor surface and the second slope comprises an angle extending downwardly toward the drain outlet.

3. The drain assembly of claim 1, further comprising fasteners securing the drain cover to the drain member and wherein the flooring surface is compressed between the drain cover and the drain member.

4. The drain assembly of claim 1, wherein the adhesive layer comprises at least one of epoxy, vinyl glue, and adhesive tape.

5. The drain assembly of claim 1, wherein the flooring surface comprises at least one of vinyl, tile, stone, and high build epoxy coating.

6. A drain assembly for a gravity fed floor drain, the assembly comprising:

a lower subfloor panel and an upper subfloor panel, the lower subfloor panel and the upper subfloor panel secured together by an adhesive layer provided therebetween, wherein at least one of the upper subfloor panel and the lower subfloor panel comprise a bisected honeycomb;

a drain member comprising a drain outlet extending downwardly beyond the lower subfloor panel, and a flange extending laterally away from the drain outlet over at least a portion of the lower subfloor panel, wherein a lower portion of the flange is adhered to the lower subfloor panel;

a flooring surface surrounding and extending outwardly away from the drain member;

wherein at least a portion of the flooring surface extends over at least a portion of the flange of the drain member to promote drainage toward the drain outlet, and wherein the portion of the flooring surface is adhered to an upper portion of the flange; and a drain cover operable to cover at least a portion of the drain member and wherein the drain member is secured to at least one of the flange, the upper subfloor assembly, and the lower subfloor assembly by at least one fastener.

7. The drain assembly of claim 6, wherein the flange of the drain member is secured directly to the drain cover by the at least one fastener.

8. The drain assembly of claim 6, wherein the drain cover is disposed above the drain outlet and at least a portion of the flooring surface.

9. The drain assembly of claim 6, wherein the adhesive layer comprises at least one of epoxy, vinyl glue, and adhesive tape.

10. The drain assembly of claim 6, wherein the flooring surface comprises at least one of vinyl, tile, stone, and high build epoxy coating.

11. The drain assembly of claim 6, wherein the drain outlet comprises a male threaded member for securing the drain outlet to a plumbing feature.

12. A drain assembly for a gravity fed floor drain, the assembly comprising:

an upper subfloor panel and a lower subfloor panel, the upper subfloor panel and the lower subfloor panel secured together by an adhesive layer;

at least one of the upper subfloor panel and the lower subfloor panel comprising a bisected honeycomb panel member;

a drain body comprising an upper portion and a lower portion, the upper portion comprising a flange extending outwardly and laterally away from a drain outlet over at least a portion of the lower subfloor panel, the subfloor panel comprising a cutout having a predetermined shape for receiving at least a portion of the drain body;

at least a portion of an underside of the flange secured to the lower subfloor panel;

a flooring surface comprising a material that is substantially non-permeable to liquids provided on the upper subfloor panel, the flooring surface extending outwardly away from the drain member, and wherein the flooring surface comprises a first slope and a second slope;

a drain cover operable to be selectively secured to at least one of the drain member and the flooring surface;

wherein at least a portion of the flooring surface extends over an outer edge of the flange and is secured to an upper portion of the flange by at least one of an adhesive and a bonding agent;

wherein at feast a portion of the flooring surface is compressed between the drain cover and the flange when the drain cover is provided in an assembled state;

wherein a lower portion of the flange is secured to the lower subfloor panel by a bonding agent;

the first slope provided at a location distal to the drain member, and the second slope provided at a location proximal to the flange, and wherein a tapered slope is provided between the first slope and the drain outlet;

wherein the second slope is provided at least partially over the flange and is greater than the first slope to promote drainage into the drain member.

13. The drain assembly of claim 12, further comprising a waterproofing membrane provided between the flooring surface and the drain member.

14. The drain assembly of claim 12, wherein the upper subfloor panel comprises a bisected honeycomb panel member provided between the flooring surface and the lower subfloor panel.

15. The drain assembly of claim 12, wherein a portion of the underside of the flange is secured to the lower subfloor panel by an adhesive layer, the adhesive layer comprising at least one of epoxy, vinyl glue, and adhesive tape.

16. The drain assembly of claim 12, wherein the flooring surface comprises at least one of vinyl, tile, stone, and high build epoxy coating.

* * * * *